United States Patent [19]

Deschamps

[11] Patent Number: 4,656,852

[45] Date of Patent: Apr. 14, 1987

[54] LOCK WITH A DOUBLE LOCKING MECHANISM FOR A SAFE, BANK COMPARTMENT OR THE LIKE

[75] Inventor: Daniel Deschamps, Montigny le Bretonneux, France

[73] Assignee: Fichet-Bauche, France

[21] Appl. No.: 752,531

[22] Filed: Jul. 8, 1985

[30] Foreign Application Priority Data

Jul. 12, 1984 [FR] France ..... 84 11114

[51] Int. Cl.[4] ..... E05B 35/12; E05B 47/06

[52] U.S. Cl. ..... 70/277; 70/279; 70/339; 70/355

[58] Field of Search ..... 70/277, 279, 353–355, 70/337, 339

[56] References Cited

U.S. PATENT DOCUMENTS

| | | | |
|---|---|---|---|
| 465,819 | 12/1891 | Harrison | 70/355 |
| 473,061 | 4/1892 | Crockett et al. | 70/279 |
| 504,462 | 9/1893 | Tinkham | 70/279 |
| 655,006 | 7/1900 | Pratt | 70/277 |
| 767,757 | 8/1904 | Jacobson et al. | 70/279 |
| 972,241 | 10/1910 | Prindle | 70/339 |
| 1,052,341 | 2/1913 | Holzhauer | 70/339 |
| 1,067,187 | 7/1913 | Mueller | 70/355 |
| 1,377,061 | 5/1921 | Deeg | 70/279 |
| 1,728,127 | 9/1929 | Katz | 70/339 |
| 1,867,244 | 7/1932 | Andrews | 70/353 |
| 1,935,225 | 11/1933 | Hurd | 70/355 |
| 3,060,716 | 10/1962 | Butter | 70/353 |
| 4,332,153 | 6/1982 | Miles | 70/339 |
| 4,580,424 | 4/1986 | Evans | 70/339 |

FOREIGN PATENT DOCUMENTS

| | | | |
|---|---|---|---|
| 446108 | 3/1968 | Switzerland . | |
| 9812 | of 1895 | United Kingdom | 70/355 |

*Primary Examiner*—Thomas J. Holko
*Assistant Examiner*—Suzanne L. Dino
*Attorney, Agent, or Firm*—Steinberg & Raskin

[57] ABSTRACT

The present invention relates to a lock with a double locking mechanism comprising a first locking mechanism having tumblers movable by a first key to authorize the operation, by means of a second key, of a second locking mechanism comprising a bolt associated with a releasable fingered bolt-retaining member through the medium of a link bar pivotally mounted on the releasable member and pivotally connected by one of its ends to the bolt, whereas the other end of the bar is adapted to co-operate with a retractable stop controlled from a distance.

5 Claims, 3 Drawing Figures

LOCK WITH A DOUBLE LOCKING MECHANISM FOR A SAFE, BANK COMPARTMENT OR THE LIKE

BACKGROUND OF THE INVENTION

The present invention has essentially for a subject matter a lock with a double locking mechanism.

It is also directed to a safe or more particularly a bank compartment equipped with such a lock.

It is known that compartments rented by banks to private persons, who can thus store therein valuables of any kind, generally include a lock with a double locking mechanism, namely, a first mechanism actuated by a first key which is in the possession of the bank and which, after being actuated, authorizes the opening of the compartment by the renter or holder of the chest by means of a second key acting upon a second locking mechanism which actuates the bolt or bolts.

Usually the first locking mechanism is essentially constituted by a set of tumblers movable by the first key, whereas the second locking mechanism operated by the second key is essentially constituted by at least one bolt associated with a releasable fingered bolt-retaining means adapted to co-operate with the tumblers to allow retracting the bolt and therefore opening the lock only after the first key has moved the tumblers to an appropriate position with respect to the releasable bolt-retainer.

Now, as is readily understood, it would be interesting, in a lock of this kind, to provide for additional means of control from a distance playing the same role as the said first key. In other words, when the renter, of the compartment desires to have access to his compartment, the bank employee can, without moving from his place, act for example upon electric control means to operate the first locking mechanism and thus allow the user of the compartment to open it by means of his own key.

To allow such control from a distance, it is readily understood that, in a lock of the kind referred to above, i.e., including a simple set of tumblers for the first locking mechanism, a special mechanism must be devised which is capable of unlocking the bolt to allow its actuation by the renter of the compartment by means of his key.

SUMMARY OF THE INVENTION

The present invention has for a purpose to obviate the need for such a special and necessarily intricate mechanism allowing the locking mechanism to be operable both by a key and from a distance and provides extremely simple and low-cost mechanical means allowing freeing the lock either from a distance or by means of a key, as desired, so as to authorize its opening.

To this end, the invention has for a subject matter a lock with a double locking mechanism, in particular for a bank compartment, and of the type including a first mechanism constituted by at least one tumbler movable by a first key to authorize the operation, by means of a second key, of a second mechanism constituted by at least one bolt associated with a releasable fingered bolt-retaining means adapted to co-operate with the said tumbler to allow the opening of the lock, characterized in that, with a view to providing the said lock with a means of control from a distance in addition to, and playing the same role as, said first key, a link bar is pivotally mounted on the said releasable fingered bolt-retaining means and is pivotally connected to the bolt by one of its ends, whereas the other end of the bar co-operates with a retractable stop controlled from a distance.

According to another feature of the lock, the said releasable bolt-retaining means is independent of the bolt and is mounted movably with respect to the lock casing so that it can enter the said tumbler when the latter has been moved to an appropriate position with respect to the said bolt-retaining means by means of the said first key.

According to still another feature of the invention, the said retractable stop is constituted by a movable stud controlled from a distance and constituting for example the core of an electro-magnet, which stud in the retracted position allows retracting the bolt by means of the said second key without translation of the said releasable bolt-retaining means.

BRIEF DESCRIPTION OF THE DRAWINGS

Other features and advantages of the invention will appear more clearly as the following detailed description proceeds with reference to the appended drawings given solely by way of example and wherein.

DESCRIPTION OF THE PREFERRED EMBODIMENTS

Figure 1:
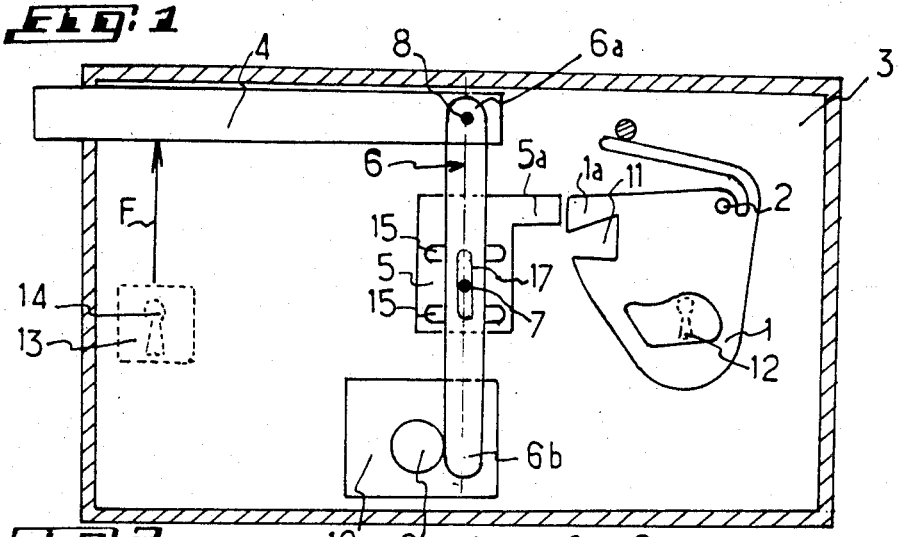
FIG. 1 is a diagrammatic side view of a lock with a double locking mechanism according to the principles of the invention and shown in its position secured against an opening.

According to an example of an embodiment of the invention and referring to the appended drawings, a lock according to the invention includes essentially one or several tumblers 1 pivoted on a pivot pin 2 secured to the lock casing 3, and at least one bolt 4 associated with a releasable fingered bolt-retaining means 5 through the medium of a link bar 6 pivoted at 7 on the fingered bolt-retainer 5, and one end **6*a* of which is pivotally connected at 8 on the bolt 4, whereas the other end 6*b* of the link bar 6 can co-operate with a retractable stop 9** controlled from a distance by a motor or the like (not shown).

The stop 9 may advantageously be constituted by the core of an electro-magnet 10.

As known per se, the tumbler or tumblers 1 are provided with a notch 11 into which can enter a finger or the like **5*a* of the releasable bolt-retainer 5, and there is diagramatically shown at 12** a keyhole adapted to receive the aforesaid first key in the possession of the bank, and authorizing the opening of the lock by the holder or the renter of the safe or of the bank compartment provided with the said lock.

At 13 is diagrammatically shown the locking and unlocking mechanism operable by means of a second key which is in the possession of the renter of the bank compartment, which key can be inserted into the keyhole indicated diagrammatically at 14. The rotation of this second key will cause known and appropriate means conventionally indicated by the arrow F to move the bolt 4 out of or into the casing 3.

The releasable bolt-retainer 5 is in a way independent of the bolt 4 and capable of translation with respect to the lock casing 3 under the action of the link bar 6. More precisely, the releasable bolt-retainer 5 is provided with oblong holes 15 through which extend pins 16 which are clearly seen in FIGS. 2 and 3 and are secured to the casing 3. Of course, an inverse structure can perfectly be contemplated without departing from the scope of the invention, i.e., the pins 16 may be carried by the releasable bolt-retainer 5 and oblong apertures 15 may be provided in the casing 3.

There is shown at 17 an oblong opening provided in the link bar 6 and through which extends a stud or the like 7 secured to the releasable bolt-retainer 5. Of course, an inverse arrangement can be contemplated for the stud 7 and the aperture 17 to obtain the same result, i.e., the pivoting of the link bar 6 on the releasable bolt-retainer 5, as well as the possibility for this bar to move with respect to the stud 7 as will be explained in detail in the following description of the operation of the lock.

Starting from the position secured against opening seen in FIG. 1 and in which the tumbler 1 hinders by its portion 1*a* the displacement of the releasable bolt-retainer 5, whereas the end 6*b* of the link bar 6 is retained by the retractable stop or pin 9, it is readily understood that in this position the bolt 4 is secured against backward movement, i.e., against movement towards the right in FIG. 1.

Figure 2:
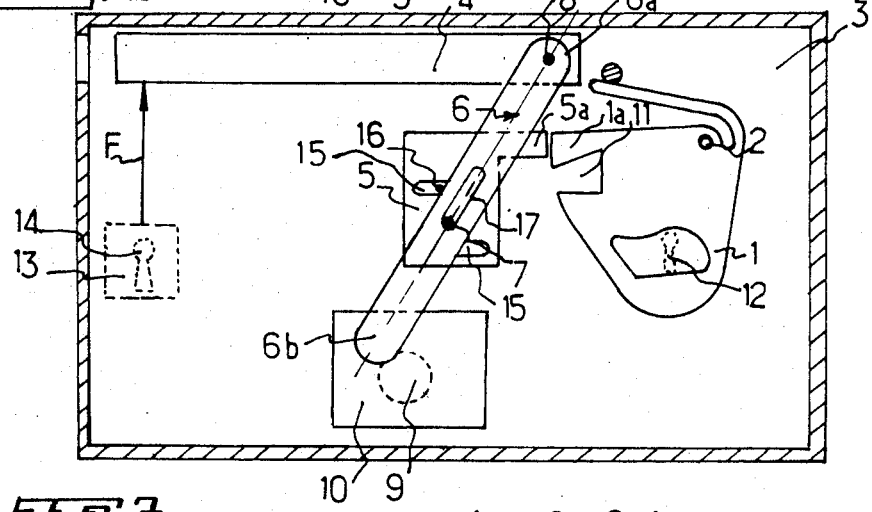
FIG. 2 is a view identical with that of FIG. 1, but showing the lock in its position freed for opening.
Figure 3:
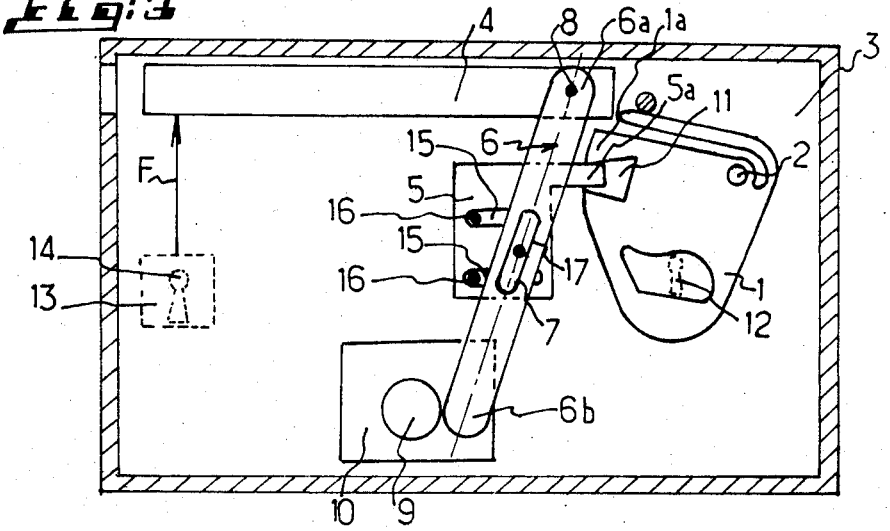
FIG. 3 is a view identical with that of FIG. 1, but showing the lock in its position freed for opening, which position is, in this case, obtained by the mechanical action of a key.

To authorize the freeing of the bolt 4 for backward movement by means of the lock mechanism 13, that is, by using the key of the renter of the bank compartment, action can be taken from a distance, as explained previously, to cause the retraction of the stop or pin 9. Thus, after inserting the key into the keyhole 14, the rotation of this key will cause a backward movement of the bolt 4, since the link bar 6 will be able to rotate about the pivot pin 7. This is seen in FIG. 2 which shows the lock in its opened position. It will be observed that no translation of the releasable fingered member 5 takes place in this case, since the finger 5*a* is still abutting against the portion 1*a* of the tumblers 1.

To authorize the freeing of the bolt 4 for backward movement, it is also possible to act mechanically by inserting a first key into the keyhole 12, thus moving the notches 11 of the tumblers 1 into alignment with the finger or fingers 5*a* of the releasable bolt-retaining member 5. Thereafter the renter of the chest can operate the mechanism 13 by means of his key, thus causing backward movement of the bolt 4 since the finger or fingers 5*a* of the bolt-retainer 5 can enter the notches 11 of the tumblers 1, as seen clearly in FIG. 3.

It will be noted that it is the link bar 6 that, upon backward movement of the bolt 4, will cause the displacement of the released member 5, since the said bar is, on the one hand, pivotally connected at 8 to the bolt 4, and, on the other hand, abuts against the pin 9.

There is therefore obtained, according to the invention, a device for authorizing the opening of a lock which operates merely by way of obstruction, either by control from a distance or by mechanical control by means of a key. Moreover, the device offers the advantage of keeping all the conventional and simple elements of a lock, such as tumblers and releasable fingered bolt-retaining means, and requires the use of a simple link bar pivotable on the said bolt-retaining means and pivotally connected to the bolt and co-operating with a stop.

Of course, the invention is by no means limited to the form of embodiment described and illustrated which has been given by way of example only.

For instance, in case it is desired to obtain a lock operable only mechanically, the stop 9 may be constituted by a simple stationary stop.

The invention therefore includes all technical equivalents to the means described as well as their combinations if the latter are carried out according to its gist.

What is claimed is:

1. In a lock with a double locking mechanism, in particular for a bank compartment, comprising a lock casing and first and second mechanisms mounted therein and which can be actuated by a first key and a second key respectively, said first mechanism having at least one tumbler movable by the first key to authorize the operation, by means of the second key, of said second mechanism which comprises at least one bolt associated with a releasable member adapted to co-operate with said tumbler to allow the opening of the lock with the second key, the improvement wherein said lock comprises a link bar (6) pivotally connected (7) to said releasable member (5) which is independent from said bolt (4) and movably mounted with respect to said lock casing (3) so as to enter said tumber (1) after said tumbler has been moved to an appropriate position with respect to said releasable member (5) by means of the first key, said link bar (6) comprises a first end (6*a*) pivotally connected (8) to said bolt (4) and a second end (6*b*), a retractable stop member (9) mounted in said lock casing, and means for controlling said stop member between retracted and non-retracted positions from a distance, said stop member co-operating with said second end (6*b*) of said link bar, so as to authorize the opening of the lock either using the first key and the second key when the stop member is in said non-retracted position or using the second key and upon actuation of said stop member control means to move said stop member to said retracted position.

2. The combination according to claim 1, wherein said retractable stop member (9) comprises a movable pin controlled from a distance and being the core of an electro-magnet (10) forming part of said stop member controlling means, which pin, when in said retracted position, allows retracting said bolt (4) in said lock casing by means of the second key without translation of said releasable member (5) which does not enter said tumbler (1).

3. The combination of claim 1, additionally comprising means for mounting said releasable member solely for translational movement with respect to said lock casing.

4. The combination of claim 3, wherein said mounting means are constituted by a slot-like aperture (15) provided in one of said releasable member (5) and lock casing (3), and at least one pin (16) secured to the other of said releasable member (5) and lock casing (3) and extending through said slot-like aperture (15) such that said releasable member is mounted for the translational movement with respect to said lock casing (3), and one of said releasable member (5) and link bar (6) is provided with a slot-like opening (17) while the other of said releasable member (5) and link bar (6)

is provided with a stud (7) secured thereto and extending through said slot-like opening (17), said link bar adapted to pivot about said stud (7) when said stop member (9) is in said retracted position.

5. The combination of claim 4, wherein said slot-like aperture (15) is provided in said releasable member (5) and said at least one pin (16) is secured to said lock casing, and said slot-like opening (17) is provided in said link bar (6) and said stud (7) is secured to said releasable member (5).

* * * * *